US010734184B1

(12) United States Patent
Smith et al.

(10) Patent No.: US 10,734,184 B1
(45) Date of Patent: Aug. 4, 2020

(54) WAFER SCALE IMAGE INTENSIFIER

(71) Applicant: Eagle Technology, LLC, Melbourne, FL (US)

(72) Inventors: Arlynn W. Smith, Blue Ridge, VA (US); Dan Chilcott, Buchanan, VA (US)

(73) Assignee: Elbit Systems of America, LLC, Forth Worth, TX (US)

( * ) Notice: Subject to any disclaimer, the term of this patent is extended or adjusted under 35 U.S.C. 154(b) by 0 days.

(21) Appl. No.: 16/449,137

(22) Filed: Jun. 21, 2019

(51) Int. Cl.
*H01J 31/50* (2006.01)
*H01J 9/12* (2006.01)
*H01J 1/34* (2006.01)

(52) U.S. Cl.
CPC ..... *H01J 31/507* (2013.01); *H01J 1/34* (2013.01); *H01J 9/125* (2013.01); *H01J 2201/3423* (2013.01); *H01J 2231/50015* (2013.01); *H01J 2231/5016* (2013.01)

(58) Field of Classification Search
CPC .. H01J 31/507; H01J 9/125; H01J 1/34; H01J 2231/50015; H01J 2231/5016; H01J 2201/3423
See application file for complete search history.

(56) References Cited

U.S. PATENT DOCUMENTS

| | | | | |
|---|---|---|---|---|
| 6,086,944 | A | 7/2000 | Peckman et al. | |
| 6,635,509 | B1 | 10/2003 | Ouellet | |
| 6,836,059 | B2 | 12/2004 | Smith | |
| 7,075,104 | B2 * | 7/2006 | Faris | B81C 1/00071 250/370.01 |
| 7,109,644 | B2 | 9/2006 | Smith et al. | |
| 7,126,263 | B2 | 10/2006 | Peck | |
| 7,741,759 | B2 | 6/2010 | Sugiyama et al. | |
| 8,289,635 | B2 | 10/2012 | Rossi et al. | |
| 8,767,303 | B2 | 7/2014 | Rudmann et al. | |
| 8,847,373 | B1 | 9/2014 | Summers et al. | |
| 8,906,470 | B2 | 12/2014 | Overstolz et al. | |
| 9,312,869 | B2 | 4/2016 | Kriz et al. | |
| 9,637,372 | B2 | 5/2017 | Steimle et al. | |
| 9,969,611 | B1 | 5/2018 | Smith et al. | |
| 2007/0135013 | A1 * | 6/2007 | Faris | H01J 9/125 445/49 |

FOREIGN PATENT DOCUMENTS

CA 2557740 A1 10/2005

* cited by examiner

*Primary Examiner* — Joseph L Williams
*Assistant Examiner* — Jose M Diaz
(74) *Attorney, Agent, or Firm* — K&L Gates LLP

(57) ABSTRACT

A method of manufacturing a multi-layer image intensifier wafer includes fabricating first and second glass wafers, each having an array of cavities that extend between respective openings in first and second surfaces of the respective glass wafer; doping a semiconductor wafer to generate a plurality of electrons for each electron that impinges a first surface of the semiconductor wafer and to direct the plurality of electrons to a second surface of the semiconductor wafer, bonding a photo-cathode wafer to the first glass wafer; bonding the semiconductor wafer between the first and second glass wafers, and bonding the second glass wafer between the semiconductor wafer and an anode wafer (e.g., a phosphor screen or other electron detector). A section of the multi-layer image intensifier wafer may be sliced and evacuated to provide a multi-layer image intensifier.

20 Claims, 13 Drawing Sheets

FIG.2B

WAFER SCALE IMAGE INTENSIFIER

BACKGROUND

Proximity-focused image intensifiers are a mature technology. Improvements to the size and weight of these devices have been incremental over the last couple of decades.

Conventional image intensifiers are manufactured as individual units (i.e., one at a time), using labor-intensive processes that are prone to errors in component alignment, component manufacture, and spacing, and that are prone to exposure to contaminants, which can render an entire unit unusable. Moreover, resultant image intensifiers are relatively large and heavy.

FIG. 1 shows an example of an image intensifier in the prior art. During fabrication, the majority of the parts are processed individually, although the components can be processed as groups, such as described in U.S. Pat. No. 6,086,944. This type of individual device manufacturing process is a holdover from the manufacturing model used for intensifier manufacturing in the 1970's, primarily due to the geometry of the components. Techniques for manufacturing microchannel plates (MCPs) in a wafer scale format to improve the manufacturing process for that component is provided in U.S. Pat. No. 7,109,644, and techniques for individualizing the MCP before processing the final device is provided in U.S. Pat. No. 7,126,263.

Disadvantages of constructing image intensifiers based on prior art techniques include labor intensive processes in which devices are built one-at-a-time, and in which spacing/alignment of components are difficult to control. Additionally, the intensifier device is often large and heavy, and small particles introduced during fabrication can cause the entire device to become inoperable.

Accordingly, conventional image intensifiers are not suitable for modern wafer scale fabrication technologies.

SUMMARY

In an embodiment, a method of manufacturing a multi-layer image intensifier wafer includes fabricating first and second glass wafers, each having an array of cavities that extend between respective openings in first and second surfaces of the respective glass wafer; doping a semiconductor wafer to generate a plurality of electrons for each electron that impinges a first surface of the semiconductor wafer and to direct the plurality of electrons to a second surface of the semiconductor wafer, bonding a photo-cathode wafer to the first glass wafer; bonding the semiconductor wafer between the first and second glass wafers, and bonding the second glass wafer between the semiconductor wafer and an anode wafer (e.g., a phosphor screen or other electron detector). A section of the multi-layer image intensifier wafer may be sliced and evacuated to provide a multi-layer image intensifier.

DETAILED DESCRIPTION

Figure 2A:
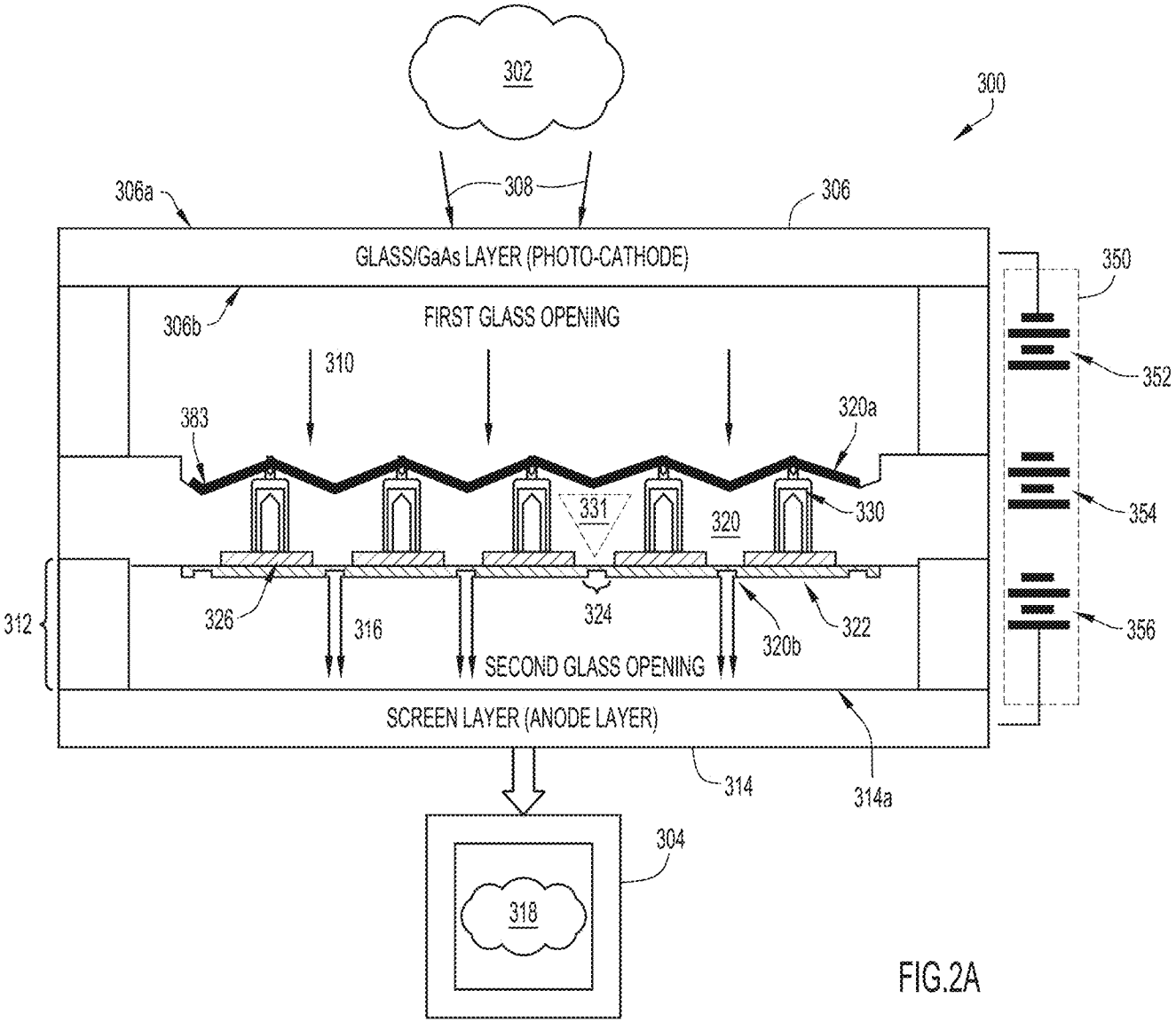
FIG. 2A is an illustration of a single wafer scale image intensifier device, in accordance with embodiments of the present invention.

FIG. 2A is a schematic representation of a wafer scale image intensifier 300 (hereinafter "image intensifier") to intensify an image 302 for display on a display device 304. Image intensifier 300 includes a photo-cathode layer 306 to convert photons 308 of the image 302 into free electrons 310, a silicon gain layer 312 to increase the number of free electrons, and a screen layer 314 to detect the increased number of free electrons 316 to produce an intensified image 318 on the display device 304. As described herein, the image intensifier comprises a series of wafers (having a plurality of image intensifiers) that are stacked and bonded to each other, including photocathode wafer 600, a glass spacer/separation wafer 610, silicon gain wafer 620, another glass separation wafer 630, and screen/anode wafer 640. After bonding of these wafers, the image intensifier is sectioned to isolate individual image intensifier devices.

Silicon gain layer 312, also referred to as electron bombarded device (EBD) 312 may be used in essentially any application where electron multiplication is needed including, without limitation, in image intensifiers found in night vision devices.

The photo-cathode layer 306 includes an input surface 306*a* and an output surface 306*b*. When photons 308 impinge the input surface 306*a* of the photo-cathode 306, each impinging photon 308 has a probability to create a free electron. Free electrons 310 resulting from impinging photons 308 pass through the photo-cathode 306 and are emitted from the output surface 306*b*. The output surface 306*b* may be activated to a negative electron affinity (NEA) state in a well-known manner to facilitate the flow of the electrons 310 from the output surface 306*b* of the photo-cathode 306.

The peripheral surface of the photo-cathode 306 may be coated with a conducting material (not shown), such as chrome, to provide an electrical contact to the photo-cathode 306.

In an exemplary embodiment, the photo-cathode 306 is formed from a photo-cathode wafer made from semiconductor materials such as glass and gallium arsenide (GaAs) which exhibit a photo emissive effect. It is noted that other III-V materials can be used such as GaP, GaInAsP, InAsP, InGaAs, etc. Alternatively, the photo-cathode may be formed using a known bi-alkali. In the exemplary photo-cathode 306, the photo-emissive semiconductor material absorbs photons. The absorbed photons cause the carrier density of the semiconductor material to increase, thereby causing the material to generate a photo-current of electrons passing though the photo-cathode 306 for emission from the output surface 306*b*. The photo-cathode is fabricated as a whole wafer to avoid sectioning, contact formation, and individual etching until after wafer assembly.

Gain layer or EBD 312, a semiconductor structure, multiplies the electrons emitted from the output surface 306*b* of the photo-cathode 306. EBD 312 includes an input surface 320*a* and an emission surface 320*b* opposite the input surface 320*a*. As described in detail below, the semiconductor structure EBD 312 is doped, e.g., in a first doped region 383 and a second doped region (or blocking region) 330, to direct the flow of electrons to emission areas (represented by emission area 324) on the emission surface 320*b*. Thus, the doped regions predefine the emission areas 324. The emission areas 324 are activated to a negative electron affinity (NEA) state in a well-known manner to facilitate the flow of electrons from the emission areas 324 of the semiconductor structure. In an exemplary embodiment, the semiconductor structure is silicon and is approximately 20-30 microns thick. Alternatively, the semiconductor structure 316 may be formed from another type of semiconductor material such as GaAs.

Proximal to blocking regions 330 are blocking areas (represented by blocking areas 326) at the emission surface 320*b*. The blocking areas 326 inhibit the flow of electrons into and out of the semiconductor structure through the emission surface 320*b*, thereby maintaining spatial fidelity. Also, blocking structure 322 may perform other functions, such as reducing dark current and preventing damage to the blocking regions 330, in addition to blocking the flow of electrons. In certain exemplary embodiments, it is contemplated that the semiconductor structure will provide suitable electron multiplication without a blocking structure 322. In accordance with these embodiments, the blocking structure 322 may be eliminated.

The EBD 312 includes a plurality of electron bombarded cells (EBCs). In the illustrated EBC (e.g., FIG. 2A), a first doped region 383 is in contact with the input surface 320*a* of the semiconductor structure 312 and a second doped region (blocking region) 330 is in contact with the emission surface 320*b* and extends toward the input surface 320*a*. The blocking structure 322 is disposed on the emission surface 320*b* of the semiconductor structure.

Electrons 310 that impinge the input surface 320*a* of the EBD 312 create an increased number of electrons 316. The first doped region 383 at the input surface of EBD 312 is doped to force the increased number of electrons 316 away from the input surface 320*a* into the EBD 312, thus inhibiting recombination of electrons at the input surface 320*a*. Inhibiting the recombination of electrons at the input surface ensures that more electrons flow through the semiconductor structure to the emission surface 320*b*, thereby increasing efficiency. In an exemplary embodiment, the first doped region 383 is doped with a conventional p-type dopant such as boron (e.g., using a pureB deposition process) or aluminum for a semiconductor structure 312 comprising silicon. In the exemplary embodiment, the first doped region 383 is heavily doped, e.g., $10^{18}$ or $10^{19}$ parts per cubic centimeter or more, and is approximately 100-300 Å deep. Other suitable dopants, concentrations, and dimensions for use with silicon semiconductors and other semiconductor materials, e.g., GaAs, will be readily apparent to those skilled in the art of semiconductor fabrication.

The second doped region 330 is doped to direct the increased number of electrons, emitted as electrons 316, toward the emission areas 324. The second doped region 330 acts as a funnel to channel the increased number of electrons through channel regions 331 between the second doped regions 330, which may be generated from electrons that impinge essentially anywhere upon the input surface 320*a*, to the emission areas 324 on the emission surface 320*b*. Channel region 331 extends from the input surface 320*a* to the emission area 324, having a wider cross-sectional area near the input surface 320*a* and narrowing as it approaches the emission area 324. In an exemplary embodiment, the second doped region 330 is moderately doped with a conventional p-type dopant such as boron or aluminum for a silicon semiconductor structure, e.g., $10^{17}$ parts per cubic centimeter. Other suitable dopants, concentrations, and dimensions for use with silicon semiconductors and other semiconductor materials, e.g., GaAs, will be readily apparent to those skilled in the art of semiconductor fabrication.

In the exemplary embodiment, the second doped region 330 narrows at the input surface 320*a* so that the second doped region 330 does not interfere with the generation of the increased number of electrons 316 at the input surface 320*a*, thereby enabling the EBC 312 to have an effective electron multiplication area approaching 100%, e.g., up to 100%.

Figure 2B:
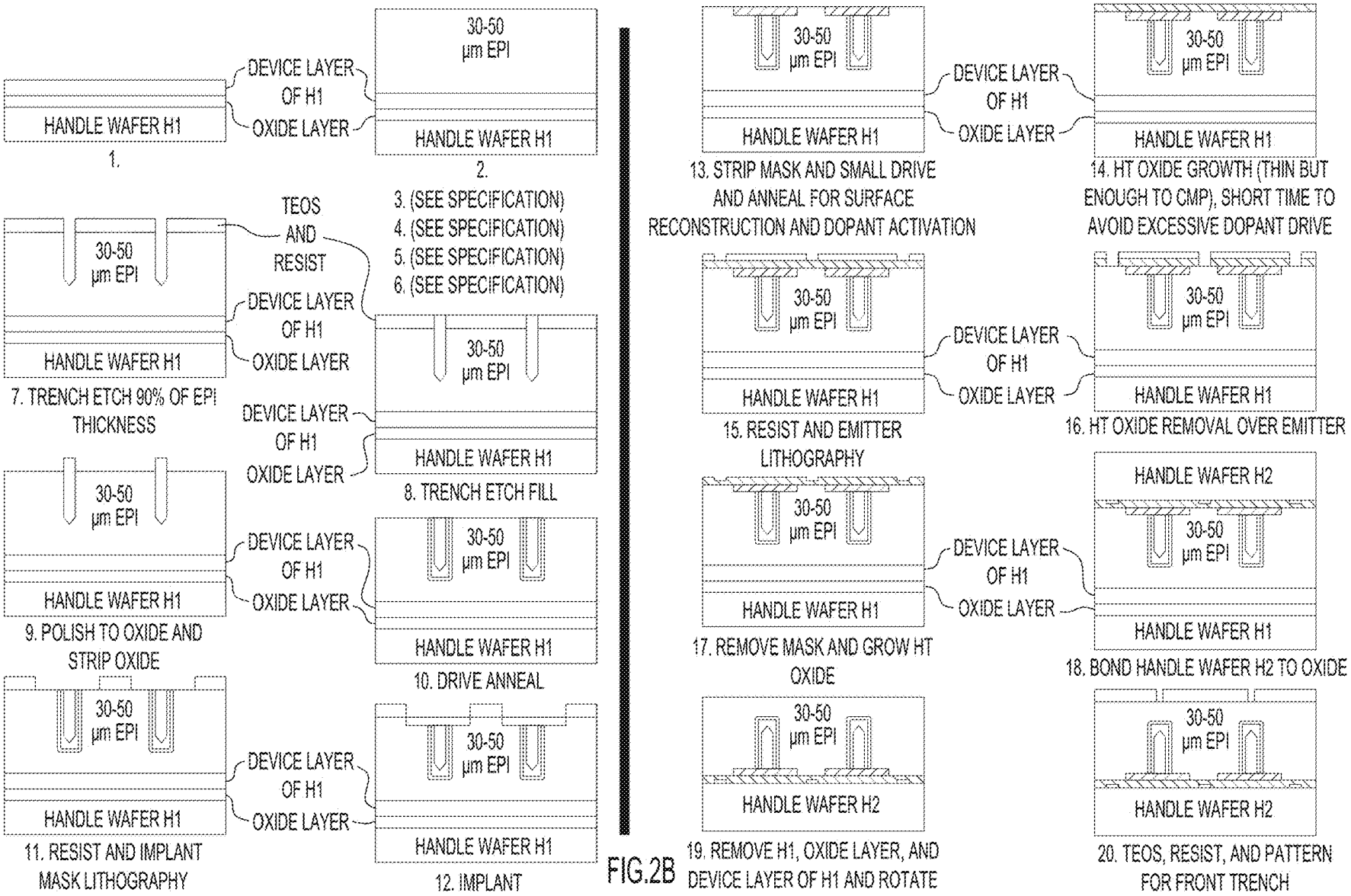
FIGS. 2B-2C are illustrations of a fabrication process for wafer scale image intensifier devices, in accordance with embodiments of the present invention.
Figure 2C:
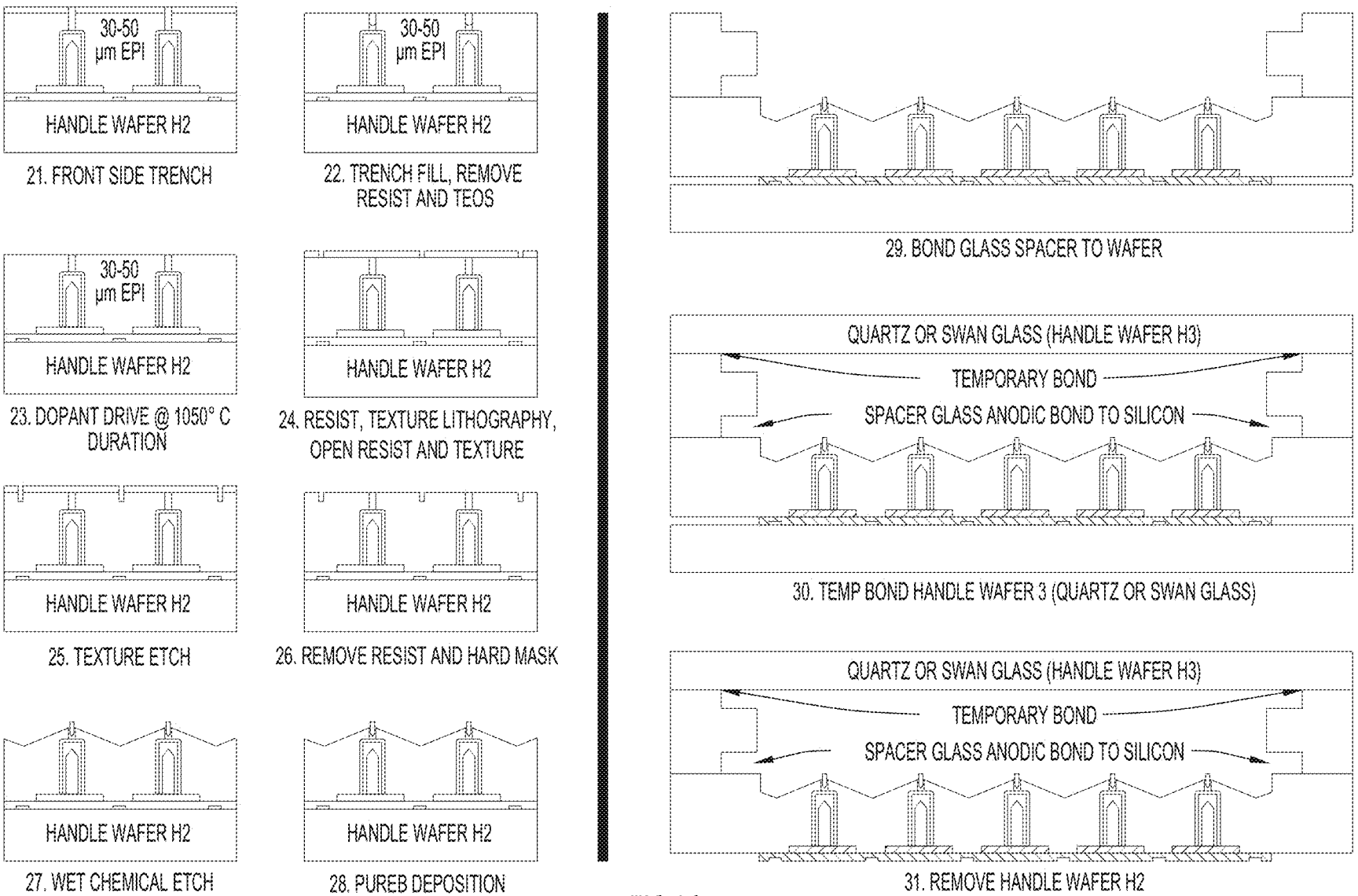

Additional details about EBD 312 are provided with respect to the fabrication process depicted in FIGS. 2B-2C.

The illustrated emission areas 324 are geometric shapes defined by the blocking structures 322. The emission areas 324 may be squares, circles, or essentially any geometric shape. In an exemplary embodiment, the blocking structure 322 extends for 10-20 microns between emission areas 324, and the emission areas 324 are about 0.5-2.0 microns in diameter. Thus, in accordance with this embodiment, the blocking structure 322 covers more than 80% of the emission surface 320*b* (FIG. 2A) of the EBD 312.

The individual EBCs (wherein an individual EBC corresponds to a region of the EBD 312, a channel region 331, and an emission area 324) may form an array within the EBD 312. The illustrated array is square, however, the array may have any suitable geometric shape, e.g., circular or rectangular, depending upon the format of the input and/or output electrons (e.g., circular for lens compatibility and square/rectangular for integrated circuit compatibility). In an exemplary embodiment, to replicate a conventional micro channel plate used in an image intensifier tube, a square array exceeding 3000×3000 EBCs 332 would be used. Each of the EBCs, and their associated emission areas 324, correspond to regions of the input surface 320*a* such that the array of EBCs pixelate the electrons received at the input surface 320*a* of the semiconductor structure 312. The number of EBCs actually employed in an array may be many more or less depending on the size of the individual EBCs and the desired resolution of the image intensifier 300.

Referring back to FIG. 2A, the anode 314 receives the increased number of electrons from the EBD 312 at an input surface 314*a*. In an exemplary embodiment, the anode or sensor 314 is a conventional integrated circuit having a CMOS substrate and a plurality of collection wells commonly used in prior art image intensifier tubes. Electrons collected in the collection wells are processed using standard signal processing equipment for CMOS sensors to produce an intensified image signal that is sent through an output to a conventional image display device 304. In an alternative embodiment, the anode 314 is a phosphor screen that converts the increased number of electrons to photons directly. The peripheral surface of the anode 314 may be coated with a conducting material (not shown), such as chrome, to provide an electrical contact to the anode 314.

A biasing circuit 350 may provide biasing current to the image intensifier 300. The biasing circuit 350 may include a first electrical circuit 352, a second electrical circuit 354, and a third electrical circuit 356. The first electrical circuit 352 provides a biasing voltage between the photo-cathode 306 and the EBD 312, the second electrical circuit 354 provides a biasing voltage between the input surface 320*a* of the EBD and the blocking structure 322, and the third electrical circuit 356 provide a biasing voltage between the EBD 312 and anode 314.

In some aspects, EBD 312 may generate several hundred electrons in each EBC that receives an electron. Since several hundred electrons may be generated by each EBC within the EBD 312 that receives an electron, the number of electrons exiting the EBD 312 is significantly greater than the number of electrons that entered the EBD 312. The emitted electrons strike the input surface 314*a* of the sensor 314, which generates a representation of an intensified image or converts the electrons into photons of an intensified image 318 for display on a display device 304.

FIGS. 2B and 2C show a multi-step fabrication process for the wafer scale image intensifiers. Fabrication is represented as a sequence of steps, however, it is understood that other sequences of operations are possible and fall within the scope of this disclosure.

Step 1 shows a substrate on which the device is generated with a handle wafer H1, an oxide layer, and a device layer of H1. The device layer is of a suitable thickness for growth of monocrystalline silicon (epitaxial silicon).

Step 2 shows growth of an epitaxial silicon layer, e.g., between 30-50 microns. Steps 3-6 include preparation of the epitaxial silicon layer for trenching, which is ultimately used to produce blocking regions 330. Step 3 involves deposition of tetraethyl orthosilicate (TEOS), which is liquid at room temperature and typically used to produce silicon dioxide. Step 4 involves placement of zero layer marks for alignment in subsequent stage of manufacturing. Step 5 involves conversion of the TEOS to silicon dioxide and providing a spin resist coating. At step 6, trench lithography is performed to generate trenches having about 1-1.4 micron width. As shown in step 7, after trenching, a channel has been etched into epitaxial silicon. At step 8, the trench is filled, e.g., with doped silicon, and at step 9, the surface is polished to remove the oxide, leaving epitaxial silicon and the trench fill (e.g., doped silicon). At step 10, an annealing process is used to anneal the trench fill to the epitaxial silicon. At step 11, another resist layer is placed, using a mask, such that the resist is present on the surface between the filled trenches, and at step 12, an implant layer is placed between the resist layer and over each filled trench.

At step 13, the resist layer is removed, and a small drive and anneal step on the implanted silicon is performed for surface reconstruction and dopant activation. At step 14, a thin oxide layer is grown on the epitaxial and filled surfaces. At step 15, a resist layer is placed atop the oxide layer and lithography is used to create openings in the resist layer at the positions of electron emission areas 324. At step 16, the oxide layer is removed at sites of electron emission areas, exposing underlying epitaxial silicon. At step 17, the wafer is prepped, for example, by removing the mask and growing the oxide layer for binding to the handle wafer H2 (this step may be optional). At step 19, the layers of step one are removed (e.g., wafer handle H1, the oxide layer adjacent to wafer handle H1, and the device layer of H1) and the wafer is rotated. At step 20, TEOS is deposited on the epitaxial silicon, polymerized, and covered with a resist layer. The resist layer is patterned for trenching.

At step 21, the front side of the silicon (e.g., about 30-50 microns) is trenched until contacting blocking region 330. At step 22, trench fill is performed, and the resist and silicon oxide (TEOS) layer is removed. Dopant is driven into the filled trench @ 1050° Celsius for a short duration. At step 24, another layer of resist is applied, and openings in the resist are applied in preparation for texture etching. At step 25, texture etch is performed, and at step 26, the resist and hard mask are removed. At step 27, wet chemical etching using KOH is performed to generate texture at the upper surface of the epitaxial silicon. At step 28, pureB (pure boron) deposition is performed. PureB creates a shell of highly doped silicon at the upper surface of the semiconductor layer to help trap received electrons in the EBD 312. The remaining steps involve bonding the semiconductor layer, or EBD 312, to the other wafers to form the intensifier devices.

At step 29, a glass spacer wafer is bonded to the semiconductor wafer, and at step 30, a glass handle wafer H3 is bonded to the glass spacer. At step 31, handle wafer H2 is removed. The semiconductor wafer can be bonded to a lower glass spacer wafer that is bound to an anode, which may be a screen, a resistive anode, or imager. The upper handle wafer H3 may be removed and the upper glass spacer wafer bound to a photocathode. In some aspects, the bonding process may take place in a vacuum, such that the first glass opening and the second glass opening correspond to a first and second vacuum region.

In other aspects, one of skill in the art would readily understand application of megaboule MCP approaches to generate the wafer scale image intensifier devices described herein.

Figure 3:
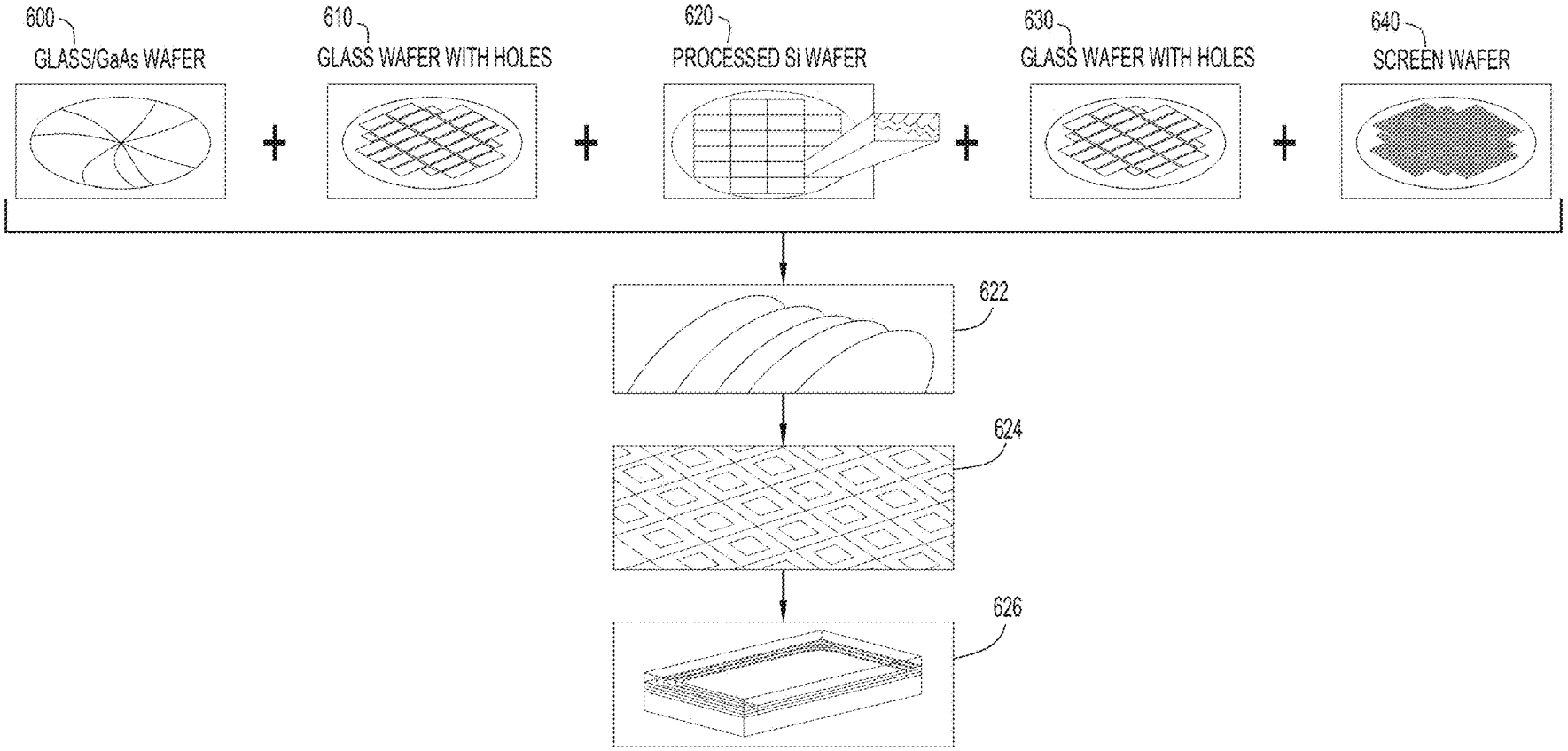
FIG. 3 is an illustration of the layers of a multi-layer image intensifier wafer, in accordance with embodiments of the present invention.

FIG. 3 is an illustration of the layers of the multi-layer image intensifier wafer comprising multi-layer image intensifier devices.

Photo-cathode wafer 600 provides the top layer of the multi-layer image intensifier device, providing optical input to the device. When photons contact this layer, the photons pass through and are converted to electrons. In some aspects, this layer may be formed of glass adhered to a GaAs wafer. In other aspects, a cathode may be grown in situ on a glass layer.

Figure 1:
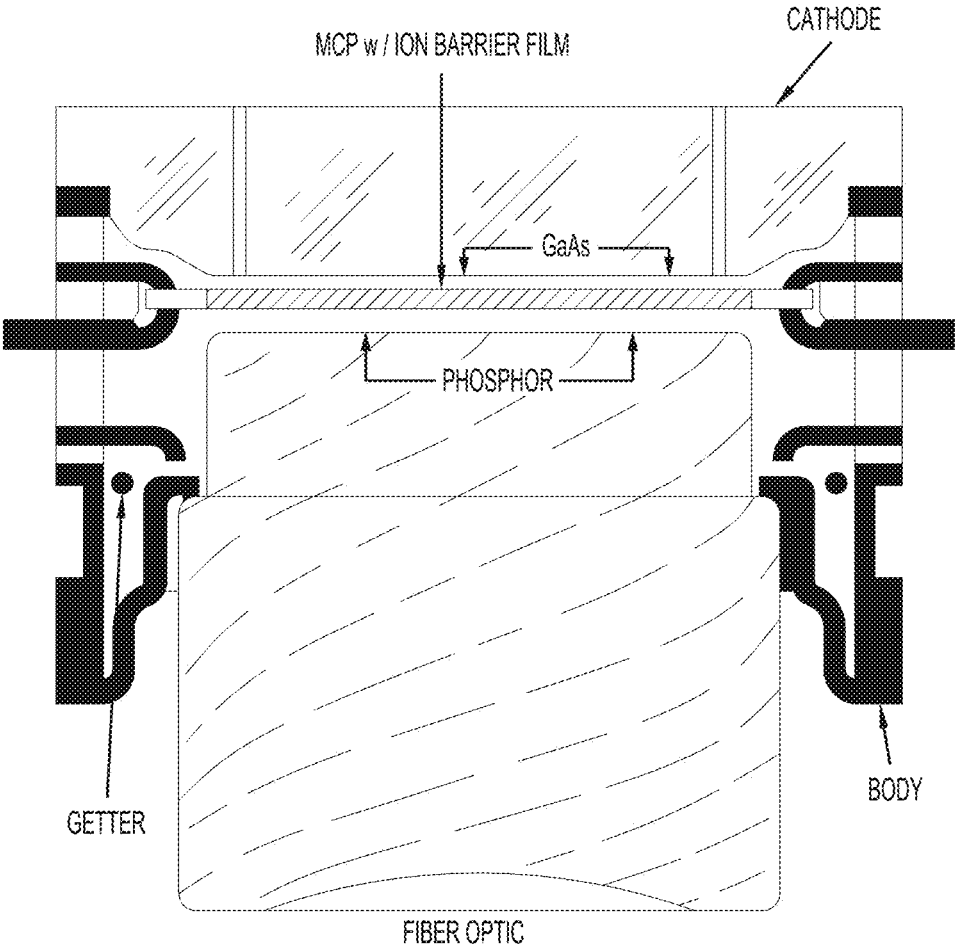
FIG.1 PRIOR ART
FIG. 1 is an illustration of an image intensifier, according to the prior art.

For example, a generation III photocathode start may be generated using a glass wafer and a GaAs wafer. The two wafers may be bonded together using any suitable technique including but not limited to thermo-compression, anodic bonding, surface activated bonding, or any other bonding technique which can survive post bond thermal excursions. In some aspects, the GaAs substrate wafer is removed, as described in the cathode process for the intensifier of FIG. 1 (see, U.S. Pat. No. 6,086,944).

In another example, a generation II intensifier (Gen II cathode) may be used, wherein a glass wafer is provided and a cathode is grown in situ on the glass wafer. This approach generates a cathode structure with minimum glass thickness to standoff atmospheric pressure and is thinner than cathode structures in the prior art. Details on bonded and activated semiconductor cathodes are known to one of skill in the art (see, U.S. Pat. No. 8,906,470). The glass/GaAs layer forms the top layer of the vacuum cavity formed by glass spacer wafer 610, once the layers of the device and bonded and sealed.

This wafer comprises a plurality of photocathode regions, each photocathode region configured to be assembled in a single image intensifier device, upon slicing of the assembled wafers.

Glass spacer wafer 610 may comprise a plurality of apertures, wherein each large aperture may be used to create a vacuum cavity, and the glass forms the walls of the vacuum cavity. Unlike other image intensifier manufacturing techniques, the glass spacer wafer provides consistent spacing between components. The remaining glass provides voltage standoff for the image intensifier device.

In some aspects, glass spacer wafer 610 may include a structure to hold getter in order to maintain the vacuum (see, U.S. Pat. No. 8,847,373 and CA Patent No. 2,557,740). Bonding between the glass spacer wafer 610 and the processed silicon gain wafer 620 provides a hermetic seal to generate a vacuum cavity to maintain the emissive material on the photocathode.

In some cases, a bond may be formed outside the vacuum cavity, for example, due to a high temperature process, such as a thermocompressive or anodic process, which may release gas that is detrimental to the image intensifying device, if performed in situ. Getter may absorb gas molecules to maintain the vacuum. Bonding of the layers is typically performed at a low temperature, due to the low thermal budget of photoemissive material on the cathode.

Glass spacer wafer 620 comprises a plurality of cavity regions, each cavity region configured to be assembled in a single image intensifier device, upon slicing of the assembled wafers.

Electron amplifier/silicon gain wafer 620 provides electron amplification for the multi-layer image intensifier device to operate. The electron amplifier may be formed by bonding a glass wafer with apertures to a processed silicon wafer. The processed silicon wafer may be formed by either of the two following options: (1) MCPs as provided in U.S. Pat. No. 7,109,644; or (2) a silicon device, as provided in U.S. Pat. No. 6,836,059, which is active to negative electron affinity.

Silicon wafer 620 comprises a plurality of amplification regions, each amplification region configured to be assembled in a single image intensifier device, upon slicing of the assembled wafers.

Glass spacer wafer 630 is another glass layer with apertures, in this case, to form another vacuum cavity before the screen wafer 640, and includes all the attributes of the previously mentioned glass spacer wafer 610.

Glass spacer wafer 630 comprises a plurality of cavity regions, each cavity region configured to be assembled in a single image intensifier device, upon slicing of the assembled wafers.

Screen wafer 640, which may be an anode wafer, provides the bottom layer of the multi-layer image intensifier wafer. The screen wafer may be any of the following types of wafers, including a resistive anode structure, a phosphor screen, a readout chip, etc.

Screen wafer 640 comprises a plurality of anode/screen regions, each anode/screen region configured to be assembled in a single image intensifier device, upon slicing of the assembled wafers.

Accordingly, the assembled wafers, including wafers 600, 610, 620, 630 and 640 are fabricated and aligned such that upon slicing into single image intensifiers, each intensifier contains (in order) a photocathode, a cavity bounded by glass wafer 610, an amplification region (from the processed silicon wafer that forms gain layer 312), a second cavity bounded by the second glass wafer, and a screen layer.

In some aspects, the image inversion in the fiber optic has a length comparable to the imaging area of the detector. The faceplate thickness can be thinner and still provide the mechanical rigidity to hold off the atmospheric pressure. The thickness of the faceplate is to meet the optical prescription of existing systems. The rest of the body geometry provides the vacuum envelop, electrical contacts, and surface path length.

Figure 4:
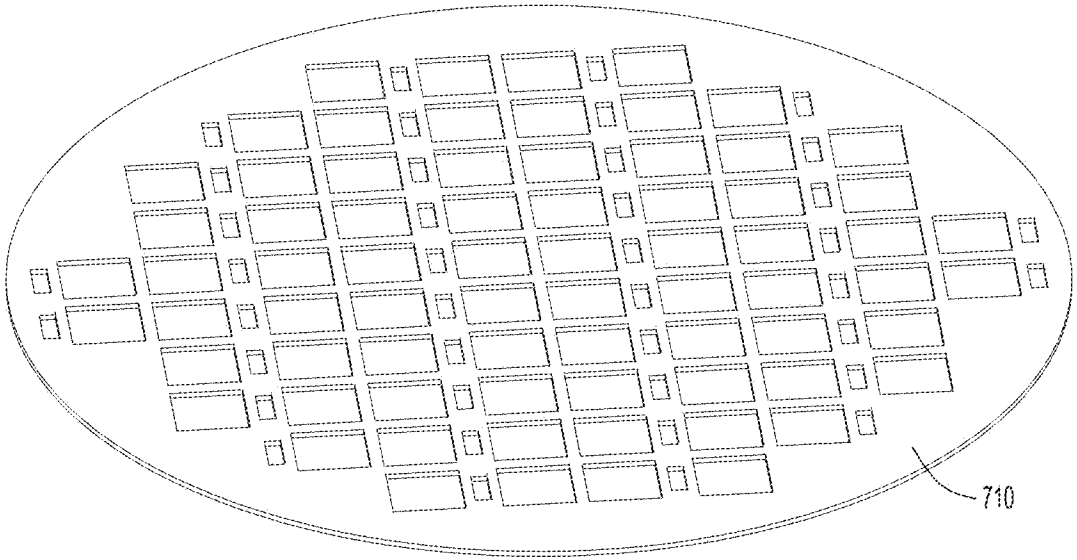
FIG. 4 shows a glass wafer layer with apertures that become vacuum cavities in the multi-layer image intensifier device, in accordance with embodiments of the present invention.

FIG. 4 shows a glass spacer wafer 710 with apertures which become vacuum cavities upon device assembly. In some aspects, for flashover protection, a non-evaporable getter may be provided along the periphery of the glass aperture to maintain the device vacuum once sealed (see U.S. Pat. No. 9,969,611), and a low temperature sealing mechanism may be provided along the periphery of the getter. The smaller apertures represent bond pad locations to provide electrical connection to the different layers of the device.

Figure 5:
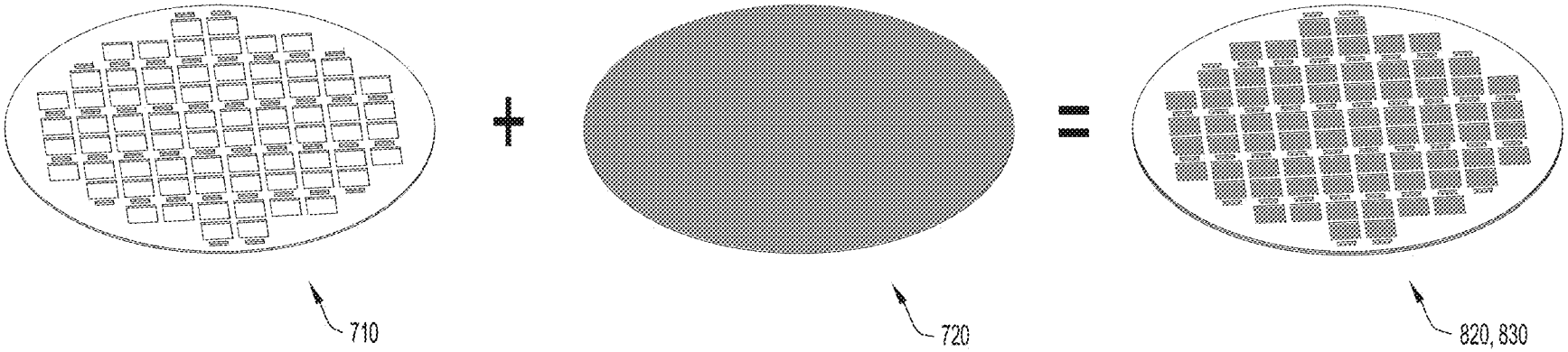
FIG. 5 shows a glass wafer layer with apertures bonded to a processed silicon wafer layer to create a gain layer wafer, in accordance with embodiments of the present invention.

FIG. 5 shows generation of a gain wafer. In this example, a spacer wafer 710 is bonded to a silicon wafer 720 to create a gain layer (820, 830). In some aspects, the spacer wafer 710 is bonded to a processed silicon wafer, as described in U.S. Pat. No. 6,836,059, to form a gain layer. In other aspects, a spacer wafer plus a processed silicon wafer may be bonded to create MCP wafers, as described in U.S. Pat. No. 7,109,644. In some aspects, the gain wafer may be made using MCP devices instead of using silicon as the gain layer. In either case, silicon or MCP, wafer bonding may be performed using anodic bonding, thermocompression, or surface activated bonding, provided that the process forms a hermetic seal.

Figure 6:
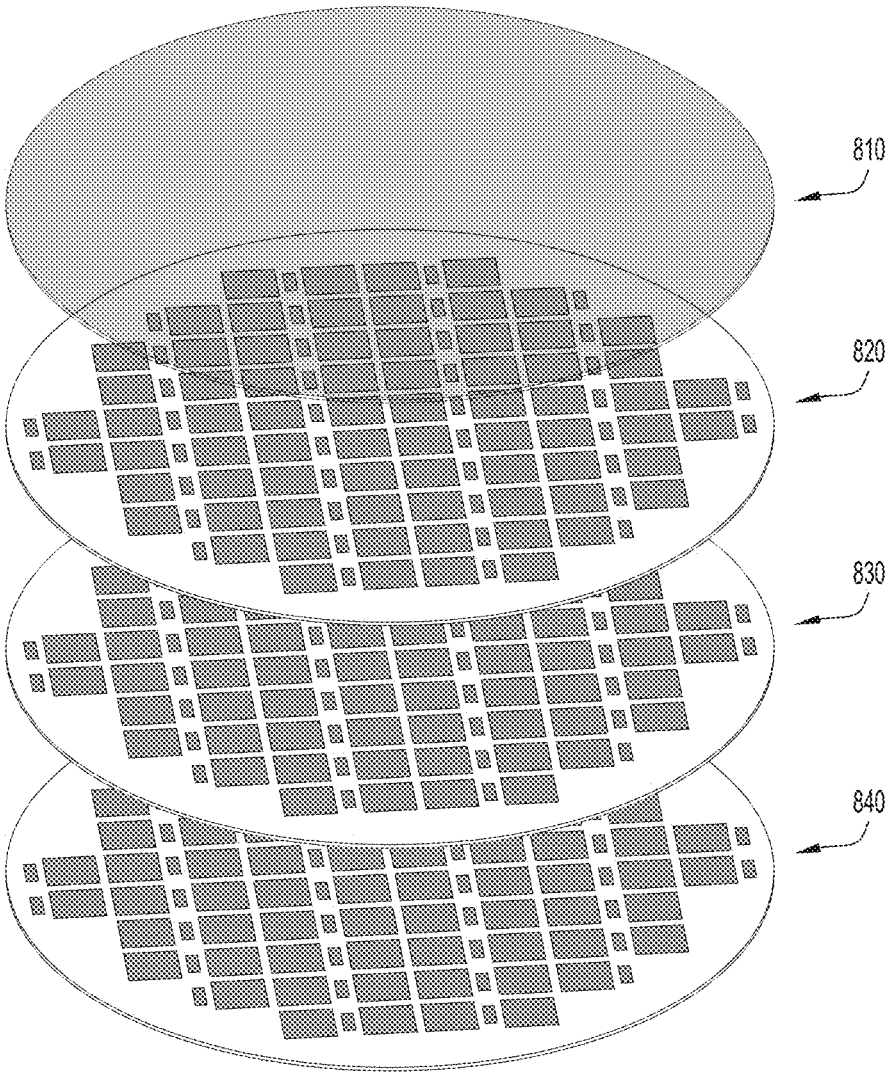
FIG. 6 shows layers, in an expanded view, of a multi-layer image intensifier wafer, in accordance with embodiments of the present invention.

FIG. 6 shows an expanded view of a four layer image intensifier wafer. Each layer of the wafer stack is described in additional detail as follows. The top layer, cathode wafer 810, for a Gen III configuration, is a glass wafer, which has been bonded to a semiconductor wafer, with a transmission mode cathode on its surface. The substrate of the semiconductor wafer has been removed through a normal removal process as described in one or more examples above.

The second layer, gain wafer 820, comprises a glass spacer wafer that is bonded to a silicon gain wafer. The third layer, gain wafer 830, comprises another glass spacer wafer that is bonded to a silicon gain wafer. The fourth layer, screen wafer 840, is another glass spacer wafer that is bonded to either a glass screen wafer, a fiber optic screen wafer, or an electron sensing device wafer.

The configuration shown in FIG. 6 is one implementation of a multi-layer image intensifier wafer fabrication. In another configuration, wafers 820 and 830 may be replaced with one spacer wafer and two MCP wafers bonded directly together in a chevron configuration. Alternatively, a multi-layer image intensifier wafer may be envisioned with only one spacer/silicon gain wafer (820 or 830), or the single spacer/silicon gain wafer may be replaced with a single spacer/MCP wafer.

Figure 7:
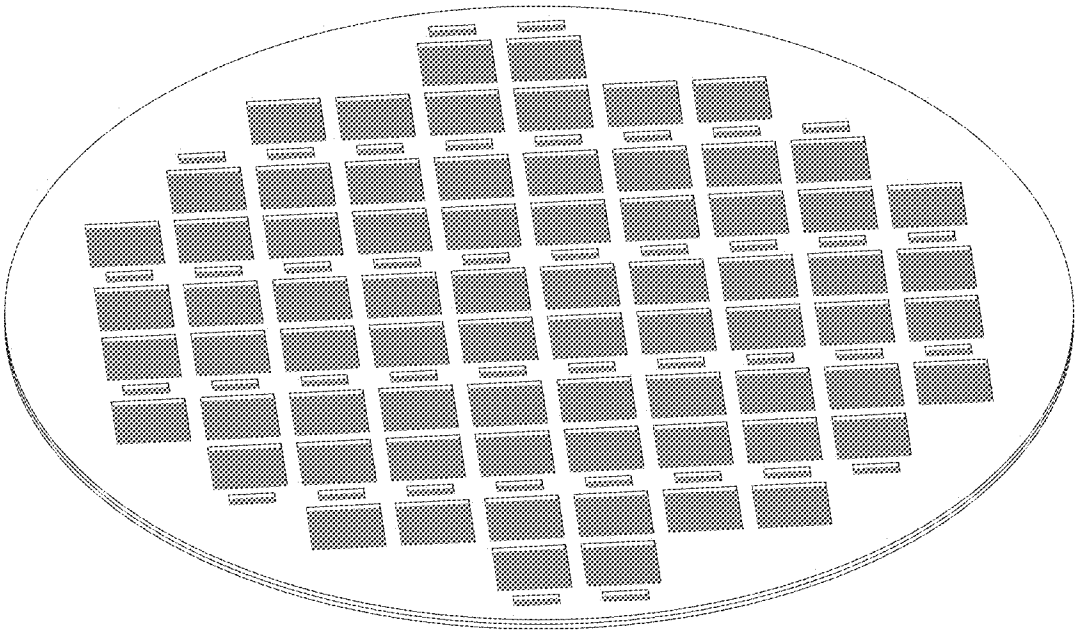
FIG. 7 shows sealed layers of the multi-layer image intensifier wafer, with a semi-transparent top wafer to show individual intensifier devices, in accordance with embodiments of the present invention.

FIG. 7 shows a sealed multi-layer image intensifier wafer, comprising bonded stacked and sealed layers of FIG. 6, with a semi-transparent front wafer to show individual devices. Sealing may be performed in an ultra-high vacuum system after the wafer has been thoroughly outgassed. The sealing process should not produce gasses which may become trapped in the sealed device. Therefore, sealing is typically performed using a low temperature process.

Figure 8:
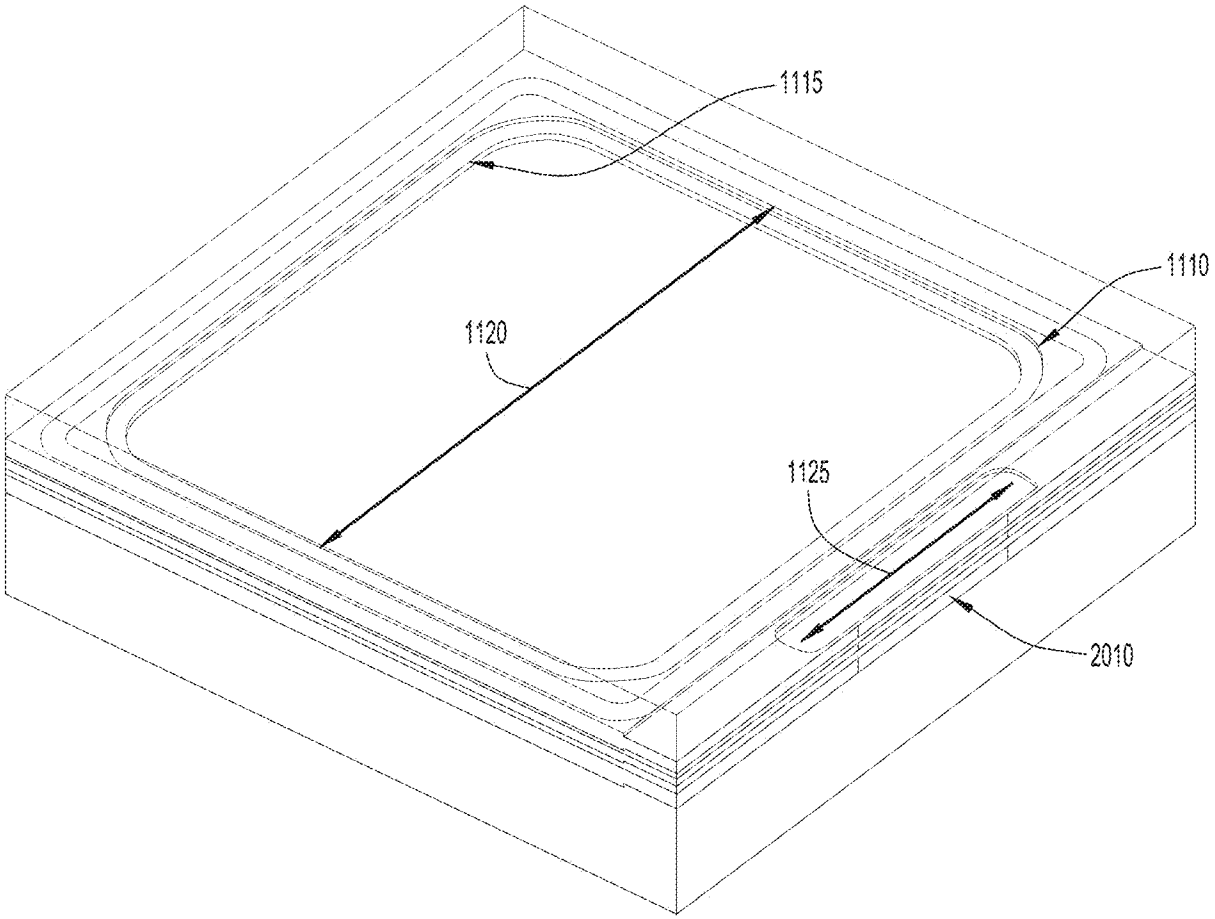
FIG. 8 shows a multi-layer image intensifier device (wafer die) from the sealed wafer layers, in accordance with embodiments of the present invention.

FIG. 8 shows a multi-layer image intensifier device after wafer bonding and slicing. Once the bonded wafer assembly from FIG. 6 is removed from the ultra-high vacuum system, the individual devices are diced from the wafer. A single die is shown in this figure. The sealed/vacuum area is bounded by the outer ring (1110), and the inner ring (1115) bounds the voltage standoff region (2010) with the getter (to preserve the vacuum) on the surface. The aperture (1120) represents the device area. The smaller aperture (1125) corresponds to the bond pad location, which is exposed when a sliver of the cathode wafer is removed.

Figure 9:
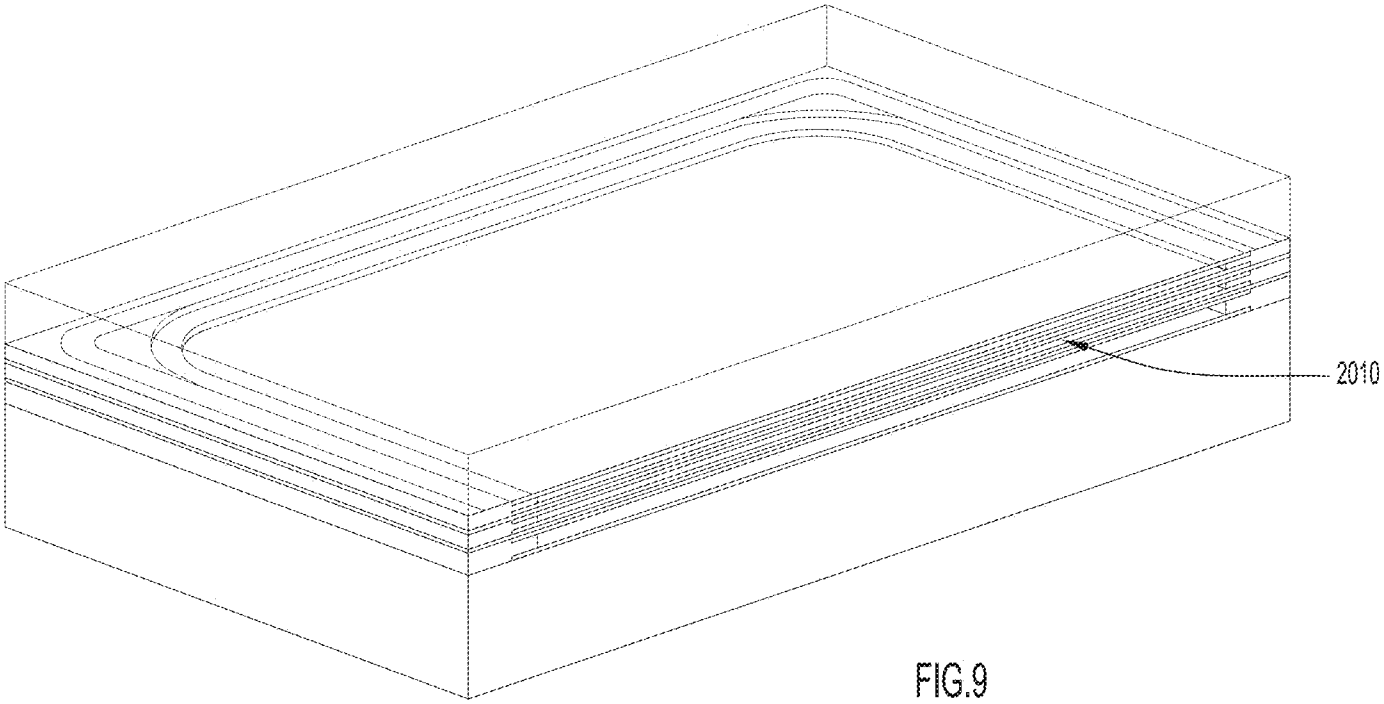
FIG. 9 shows a cross section of an individual multi-layer image intensifier device of FIG. 6, in accordance with embodiments of the present invention.

FIG. 9 shows a cross section of an individual multi-layer image intensifier device (as shown in FIG. 6) with vacuum cavities. Three individual cavities are visible as well as the voltage standoff structure 2010.

Figure 10:
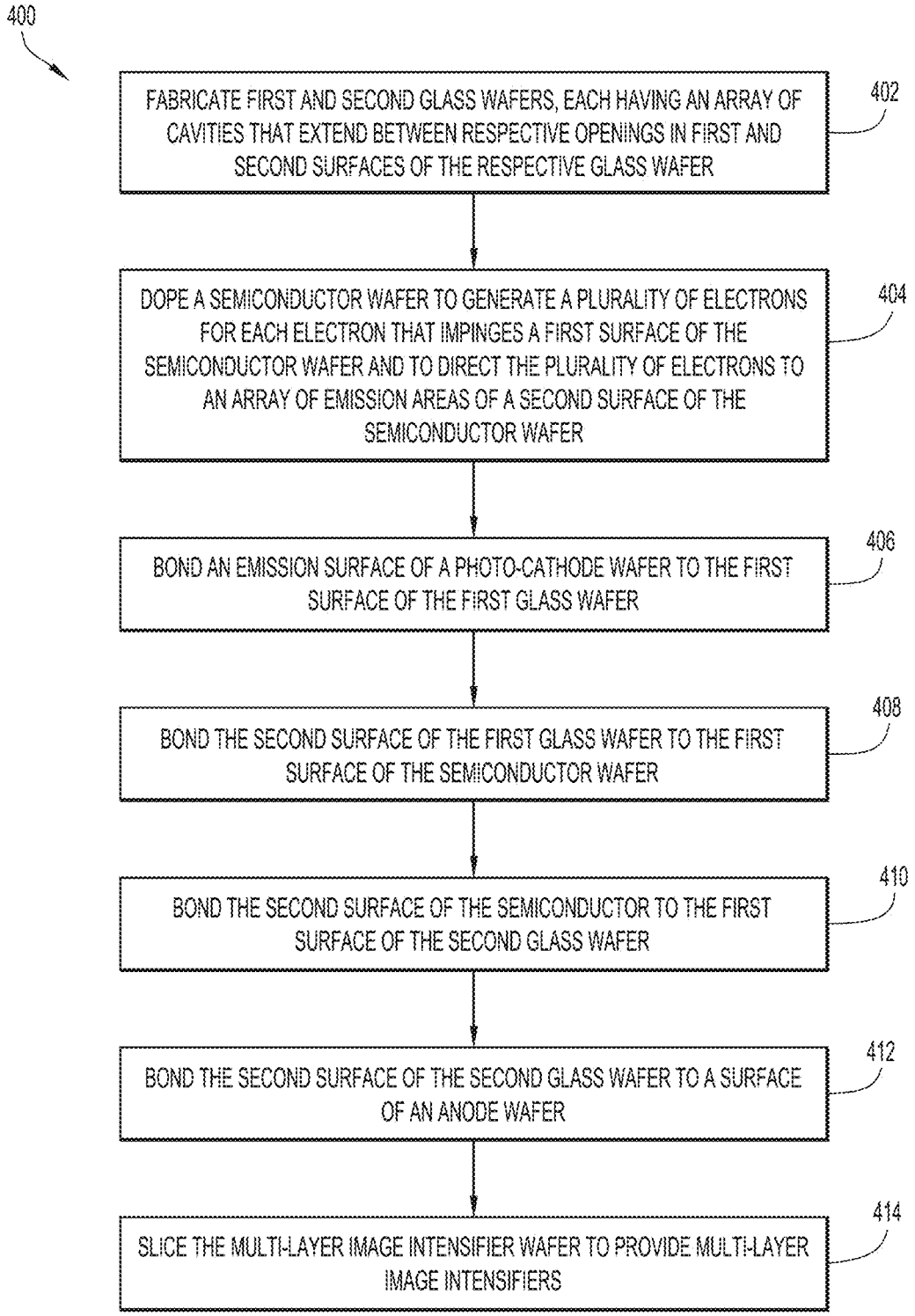
FIG. 10 is a flowchart comprising operations for manufacturing a multi-layer image intensifier wafer, and of slicing the wafer to provide a plurality of multi-layer image intensifier devices, in accordance with embodiments of the present invention.

FIG. 10 is a flowchart of method 400 of manufacturing a multi-layer image intensifier wafer, and of slicing the wafer to provide a multi-layer image intensifier device. Method 400 may be used to manufacture a device as described in one or more examples above. Method 400 is not, however, limited to the examples above.

At operation 402, first and second glass wafers are fabricated, each having an array of cavities that extend between respective openings in first and second surfaces of the respective glass wafer.

At operation 404, a semiconductor wafer is doped to generate a plurality of electrons for each electron that impinges a first surface of the semiconductor wafer and to direct the plurality of electrons to an array of emission areas of a second surface of the semiconductor wafer.

The doping at operation 404 may include doping the semiconductor wafer to absorb stray electrons and/or stray photons that contact the second surface of the semiconductor wafer, such as described in one or more examples herein.

The doping at operation 404 may include doping the semiconductor wafer to reduce localized intense lights, such as described in one or more examples herein.

At operation 406, an emission surface of a photo-cathode wafer is bonded to the first surface of the first glass wafer.

At operation 408, the second surface of the first glass wafer is bonded to the first surface of the semiconductor wafer.

At operation 410, the second surface of the semiconductor is bonded to the first surface of the second glass wafer.

At operation 412, the second surface of the second glass wafer is bonded to a surface of an anode wafer.

The processes described at operations 402 through 412 provides a multi-layer image intensifier wafer.

At operation 414, the multi-layer image intensifier wafer is sliced to provide multiple multi-layer image intensifier devices.

Method 400 may further include evacuating the cavities of the first and second glass wafers.

Method 400 may further include fabricating the photocathode wafer with one or more of glass and/or gallium arsenide.

Figure 11:
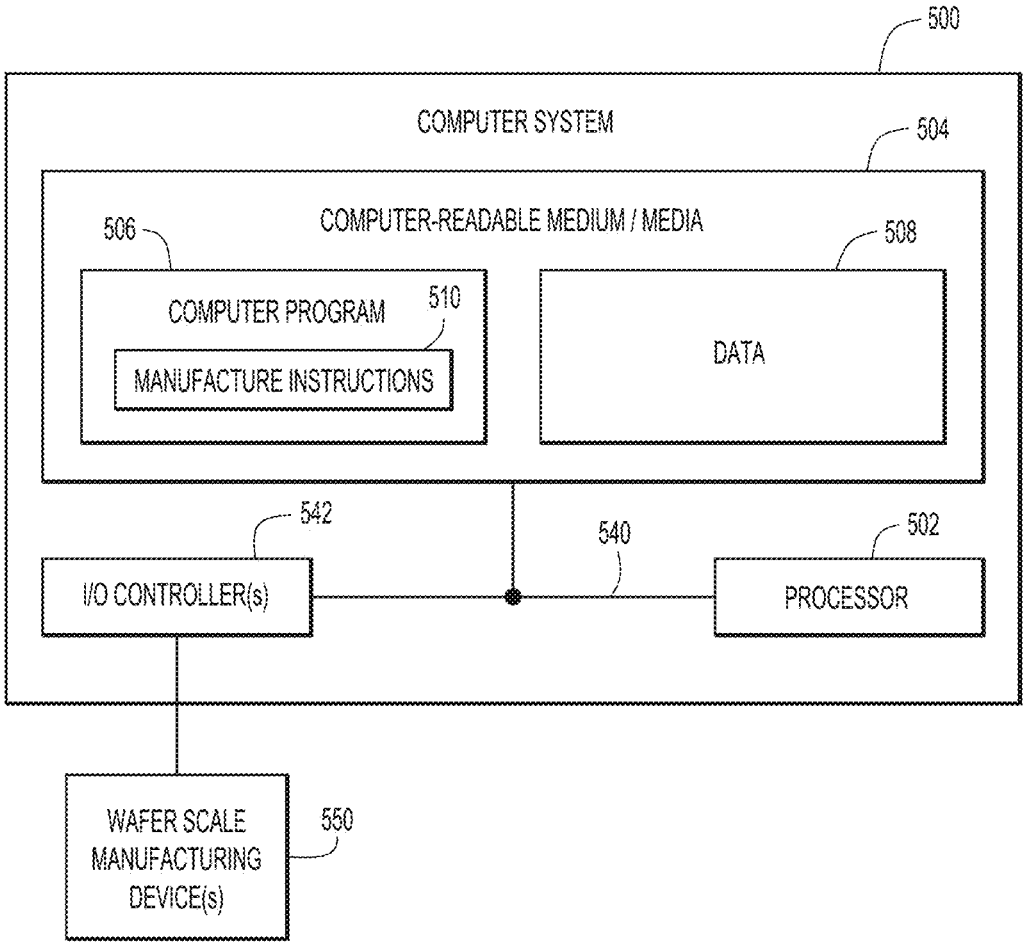
FIG. 11 is a block diagram of a computer system configured to control a manufacturing device to manufacture or fabricate a multi-layer image intensifier wafer, and to slice the multi-layer image intensifier wafer to provide a plurality of multi-layer image intensifier devices.

FIG. 11 is a block diagram of a computer system 500, configured to control a manufacturing device to manufacture or fabricate a multi-layer image intensifier wafer, and to slice the multi-layer image intensifier wafer to provide multiple multi-layer image intensifier devices, such as described above with respect to method 400. Computer system 500 is not, however, limited to the example of method 400.

Computer system 500 includes one or more processors, illustrated here as a processor 502, to execute instructions of a computer program 506 encoded within a computer-readable medium 504. Medium 504 may include a transitory or non-transitory computer-readable medium.

Processor 502 may include one or more instruction processors and/or processor cores, and a control unit to interface between the instruction processor(s)/core(s) and computer-readable medium 504. Processor 502 may include, without limitation, a microprocessor, a graphics processor, a physics processor, a digital signal processor, a network processor, a front-end communications processor, a co-processor, a management engine (ME), a controller or microcontroller, a central processing unit (CPU), a general purpose instruction processor, and/or an application-specific processor.

Computer-readable medium 504 further includes data 508, which may be used by processor 502 during execution of computer program 506, and/or generated by processor 502 during execution of computer program 506.

In the example of FIG. 11, computer program 506 includes manufacturing instructions 510 to cause processor 502 to control a wafer scale manufacturing device(s) 550 to manufacture a multi-layer image intensifier wafer, and to slice the multi-layer image intensifier wafer to provide multiple multi-layer image intensifier devices, such as described in one or more examples above.

The computer may additionally control the following operations via manufacturing instructions 510 to: thermally outgas the wafers (e.g., all wafers including wafers 600, 610, 620, 630, 640), activate the GaAs photocathode wafer 600 to negative electron affinity (or deposit a multi-alkali photocathode), activate the silicon wafer 620 to negative electron affinity for the gain layers, electron scrub the anode wafer 640 to remove residual gases, activate getters to seal the wafers, and generate seals under vacuum.

The wafers may be fabricated and aligned such that the cavities of the first wafer are aligned with the amplification/gain regions of the silicon wafer, the amplification regions of the silicon wafer may be aligned with the cavities of the second wafer, and the cavities of the second wafer may be aligned with anodes of the anode wafer. The aligned wafers are sealed and sliced with a vacuum in the respective cavities of the first and second glass wafers.

Computer system 500 further includes communications infrastructure 540 to communicate amongst devices and/or resources of computer system 500.

Computer system 500 further includes an input/output (I/O) device(s) 542 to interface with one or more other devices, illustrated here as including wafer scale manufacturing device(s) 550.

Advantages of present invention embodiments, include but are not limited to, the ability to fabricate multi-layer image intensifier devices during a single fabrication run of a wafer, which saves time and reduces labor. Present invention embodiments allow for lightweight and small multi-layer image intensifier devices.

Additionally, the present techniques are robust to manufacturing errors, in that a stray particle on the wafer may destroy a single multi-layer image intensifier device, but the other devices remain viable. Additionally, present techniques simplify alignment and spacing of microstructures, which reduces manufacturing complexity for multiple multi-layer image intensifier devices on the wafer.

While a particular embodiment of the present invention has been shown and described in detail, adaptations and modifications will be apparent to one skilled in the art. Such adaptations and modifications of the invention may be made without departing from the scope thereof, as set forth in the following claims.

What is claimed is:

1. A method, comprising:

manufacturing a multi-layer image intensifier wafer, including, fabricating first and second glass wafers, each having an array of cavities that extend between respective openings in first and second surfaces of the respective glass wafer;

doping a semiconductor wafer to generate a plurality of electrons for each electron that impinges a first surface of the semiconductor wafer and to direct the plurality of electrons to an array of emission areas of a second surface of the semiconductor wafer;

bonding an emission surface of a photo-cathode wafer to the first surface of the first glass wafer;

bonding the second surface of the first glass wafer to the first surface of the semiconductor wafer;

bonding the second surface of the semiconductor to the first surface of the second glass wafer; and bonding the second surface of the second glass wafer to a surface of an anode wafer; and slicing a section of the multi-layer image intensifier wafer to provide a multi-layer image intensifier.

2. The method of claim 1, further including:

evacuating the cavities of the first and second glass wafers of the sliced section.

3. The method of claim 1, further including:

fabricating the photo-cathode wafer with one or more of glass and gallium arsenide.

4. The method of claim 1, wherein the doping the semiconductor wafer includes:

doping the semiconductor wafer to include a light shield region.

5. The method of claim 1, wherein the doping a semiconductor wafer includes:

doping the semiconductor wafer to reduce localized light intensity.

6. A non-transitory computer readable medium encoded with a computer program, including instructions to cause a processor to control a manufacturing device to:

manufacture a multi-layer image intensifier wafer, including to, fabricate first and second glass wafers, each having an array of cavities that extend between respective openings in first and second surfaces of the respective glass wafer;

dope a semiconductor wafer to generate a plurality of electrons for each electron that impinges a first surface of the semiconductor wafer and to direct the plurality of electrons to an array of emission areas of a second surface of the semiconductor wafer;

bond an emission surface of a photo-cathode wafer to the first surface of the first glass wafer;

bond the second surface of the first glass wafer to the first surface of the semiconductor wafer;

bond the second surface of the semiconductor wafer to the first surface of the second glass wafer; and bond the second surface of the second glass wafer to a surface of an anode wafer; and slice a section of the multi-layer image intensifier wafer to provide a multi-layer image intensifier.

7. The non-transitory computer readable medium of claim 6, wherein the computer program further includes instructions to cause the processor to control the manufacturing device to:

evacuate the cavities of the first and second glass wafers of the sliced section.

8. The non-transitory computer readable medium of claim 6, wherein the computer program further includes instructions to cause the processor to control the manufacturing device to:

dope the semiconductor wafer to absorb one or more of stray electrons and stray photons that contact the second surface of the semiconductor wafer.

9. A wafer scale device comprising:

a wafer comprising a plurality of photo-cathodes;

a first glass wafer having a plurality of first cavities;

a semiconductor wafer configured to have a plurality of electron amplification regions, wherein an electron amplification region generates a plurality of electrons for each electron that impinges a first surface of the semiconductor wafer and directs the plurality of electrons to an array of emission areas of a second surface of the semiconductor wafer;

a second glass wafer having a plurality of second cavities;

an anode wafer having a plurality of anodes, wherein a first surface of the first glass wafer is bonded to an output surface of the photo-cathode wafer and a second surface of the first glass wafer is bonded to an input surface of the semiconductor wafer; and a first surface of the second glass wafer is bonded to an output surface of the semiconductor wafer and a second surface of the second glass wafer is bonded to an input surface of the anode, such that each cavity of the plurality of second cavities is aligned with a respective cavity of the first plurality of first cavities.

10. The device of claim 9, wherein the wafer scale device has been sliced to provide a plurality of multi-layer image intensifiers.

11. The device of claim 10, wherein cavities of the first and second glass wafers of the sliced multi-layer image intensifier have been evacuated.

12. The device of claim 9, wherein the photocathode wafer comprises one or more of glass and gallium arsenide.

13. The device of claim 9, wherein the semiconductor wafer is doped to include a light shield region.

14. The device of claim 9, wherein the semiconductor wafer is doped to reduce localized light intensity.

15. The device of claim 9, wherein a cavity of the first glass wafer is aligned with a respective cavity of the second glass wafer.

16. The device of claim 9, wherein a cavity of the first glass wafer is aligned with an electron amplification region of the silicon wafer, the electron amplification region is aligned with a cavity of the second glass wafer, and wherein a cavity of the second glass wafer is aligned with an anode.

17. The device of claim 9, wherein the electron amplification region of the silicon wafer comprises blocking structures and channels, wherein the blocking structures direct electrons into adjacent channels during amplification of the impinging electron.

18. The device of claim 9, wherein the surface of the electron amplification region is textured.

19. The device of claim 9, wherein the first doped region is about 100-300 angstroms deep.

20. The device of claim 9, wherein getter is placed at the periphery of the first cavity and the second cavity to maintain a vacuum seal.

* * * * *